US008087726B2

(12) United States Patent
Chen

(10) Patent No.: US 8,087,726 B2
(45) Date of Patent: Jan. 3, 2012

(54) BACK CUSHION

(75) Inventor: Fu-Chieng Chen, Taipei (TW)

(73) Assignee: Formosa Sounding Corp., Taipei (TW)

( * ) Notice: Subject to any disclaimer, the term of this patent is extended or adjusted under 35 U.S.C. 154(b) by 155 days.

(21) Appl. No.: 12/612,456

(22) Filed: Nov. 4, 2009

(65) Prior Publication Data

US 2011/0101746 A1 May 5, 2011

(51) Int. Cl.

| | |
|---|---|
| ***A47C 7/18*** | (2006.01) |
| ***A47C 7/40*** | (2006.01) |
| ***A47C 7/42*** | (2006.01) |
| ***B68G 5/00*** | (2006.01) |
| ***B68G 5/02*** | (2006.01) |

(52) U.S. Cl. ..... 297/284.5; 297/230.1; 297/230.11; 297/230.13; 297/452.26; 297/452.27; 297/452.48; 5/653

(58) Field of Classification Search ..... 297/230.1, 297/230.11, 230.13, 284.5, 452.26, 452.27, 297/452.48; 5/630, 633, 653
See application file for complete search history.

(56) References Cited

U.S. PATENT DOCUMENTS 4,064,578 A * 12/1977 Yamada ..... 297/452.27
4,471,993 A * 9/1984 Watson ..... 297/284.5
4,516,568 A * 5/1985 Baxter et al. ..... 297/284.5 X
4,597,386 A * 7/1986 Goldstein ..... 297/284.5 X
4,713,854 A * 12/1987 Graebe ..... 5/653 X
4,718,724 A * 1/1988 Quinton et al. ..... 297/284.5
4,753,480 A * 6/1988 Morell ..... 297/452.27
4,824,169 A * 4/1989 Jarrell ..... 297/284.5 X
4,876,755 A * 10/1989 Parrish ..... 297/284.5 X
4,930,173 A * 6/1990 Woller ..... 297/452.48
4,989,284 A * 2/1991 Gamm ..... 5/653
5,237,713 A * 8/1993 Prager ..... 5/722
5,294,181 A * 3/1994 Rose et al. ..... 297/452.27 X
5,297,848 A * 3/1994 Grinnell ..... 297/284.5 X
5,429,852 A * 7/1995 Quinn ..... 297/452.26 X
5,433,505 A * 7/1995 Coyne et al. ..... 297/284.5 X
5,456,519 A * 10/1995 Davis ..... 297/230.13 X
5,459,896 A * 10/1995 Raburn et al. ..... 5/653
5,503,456 A * 4/1996 Rossini ..... 297/284.5 X
5,533,787 A * 7/1996 Xiang ..... 297/284.5
5,704,691 A * 1/1998 Olson ..... 297/452.26 X
5,788,332 A * 8/1998 Hettinga ..... 5/653 X
5,863,095 A * 1/1999 Rivard et al. ..... 297/230.13
6,018,832 A * 2/2000 Graebe ..... 5/653 X
6,079,784 A * 6/2000 Peachey ..... 297/284.5
6,082,824 A * 7/2000 Chow ..... 297/452.27 X
6,206,463 B1 * 3/2001 Whigham ..... 297/284.5 X
6,546,578 B1 * 4/2003 Steinmeier ..... 5/653
6,598,251 B2 * 7/2003 Habboub et al. ..... 297/452.48 X
6,625,830 B2 * 9/2003 Lampel ..... 5/653
6,666,509 B2 * 12/2003 Matsushima ..... 297/284.5 X (Continued)

*Primary Examiner* — Rodney B White
(74) *Attorney, Agent, or Firm* — Ming Chow; Sinorica, LLC

(57) ABSTRACT

A back cushion includes an enclosure portion, a buffer portion, a filler portion and a fixing portion. The enclosure portion has a first surface/layer and a second surface/layer. The buffer portion and the filler portion are placed in the internal space of the enclosure portion. The buffer portion is in contact with the first layer and the rear surface of the filler portion is in contact with the second layer. The fixing portion is connected with the second layer of the enclosure portion. The fixing portion enables the back cushion to be attached to a suitable place of a chair or a supporting member. The buffer portion allows the back of a user can be comfortably cushioned and supported and hence injuries to his back may be avoided.

10 Claims, 11 Drawing Sheets

U.S. PATENT DOCUMENTS 6,701,556 B2 * 3/2004 Romano et al. ..... 5/653
6,851,755 B2 * 2/2005 Dinkel et al. ..... 297/452.48
6,901,617 B2 * 6/2005 Sprouse et al. ..... 5/653 X
6,918,146 B2 * 7/2005 England ..... 5/653
6,938,290 B2 * 9/2005 McKinney et al. .. 297/452.27 X
7,114,776 B1 * 10/2006 Wiltberger ..... 297/284.5
7,270,377 B2 * 9/2007 Schmitz et al. ..... 297/230.1 X
7,424,761 B1 * 9/2008 Graebe ..... 5/653
7,681,264 B2 * 3/2010 Graebe ..... 5/653
7,946,654 B2 * 5/2011 Tsuber et al. ..... 297/452.26 X
2005/0121957 A1 * 6/2005 Matsushima ..... 297/284.5
2006/0037143 A1 * 2/2006 Green ..... 5/653
2008/0201853 A1 * 8/2008 Graebe ..... 5/653
2009/0217457 A1 * 9/2009 Graebe et al. ..... 5/653
2010/0289305 A1 * 11/2010 Chen ..... 297/230.13
2010/0314929 A1 * 12/2010 Hsu ..... 297/452.48

* cited by examiner

BACK CUSHION

BACKGROUND OF THE INVENTION

1. Field of the invention

The invention generally relates to a back cushion. More particularly, the invention relates to a back cushion, in which a buffer portion is used to allow the back of a user can be comfortably cushioned and supported to eliminate discomfort.

2. Description of the prior art

Many office workers would purchase a back cushion to cushion and support their back and to eliminate discomfort because they have to sit on a chair for a long time.

There are many types of back cushions available in the market. Some of them mimic the curve of our back and others may have an adjusting mechanism. The back cushions of the prior art have the following disadvantages:

1. Because everyone is unique in terms of back curve and sitting posture, the back cushions of the prior art can not provide accurate support to our back.

2. In the prior art, foam is used to support the back. Such material can not provide enough cushioning and support and hence may cause injuries to user's back.

From the above, we can see that the back cushions of the prior art have disadvantages and need to be improved.

To eliminate the disadvantages of the back cushions of the prior art, the inventor has put a lot of effort into the subject and has successfully come up with the back cushion of the present invention.

SUMMARY OF THE INVENTION

An object of the present invention is to provide a back cushion that has a buffer portion, which allows the back of a user can be comfortably cushioned and supported to avoid injuries to his back.

Another object of the present invention is to provide a back cushion that has a fixing portion, which enables the back cushion to be attached to a suitable place of a chair by the user easily.

To reach these objects, the back cushion of the present invention is disclosed. The back cushion of the present invention comprises an enclosure portion, a buffer portion, a filler portion and a fixing portion. The enclosure portion has an internal space and has a first surface/layer and a second surface/layer. The buffer portion and the filler portion are placed in the internal space of the enclosure portion to fill up the internal space. The buffer portion is in contact with the first surface and the rear surface of the filler portion is in contact with the second surface. The fixing portion is connected with the second surface of the enclosure portion. The fixing portion enables the back cushion to be attached to a suitable place of a chair or a supporting member. The buffer portion allows the back of a user may be comfortably cushioned and supported and hence injuries to his back may be avoided.

These features and advantages of the present invention will be fully understood and appreciated from the following detailed description of the accompanying Drawings.

DETAILED DESCRIPTION OF THE PREFERRED EMBODIMENTS

Figure 1:
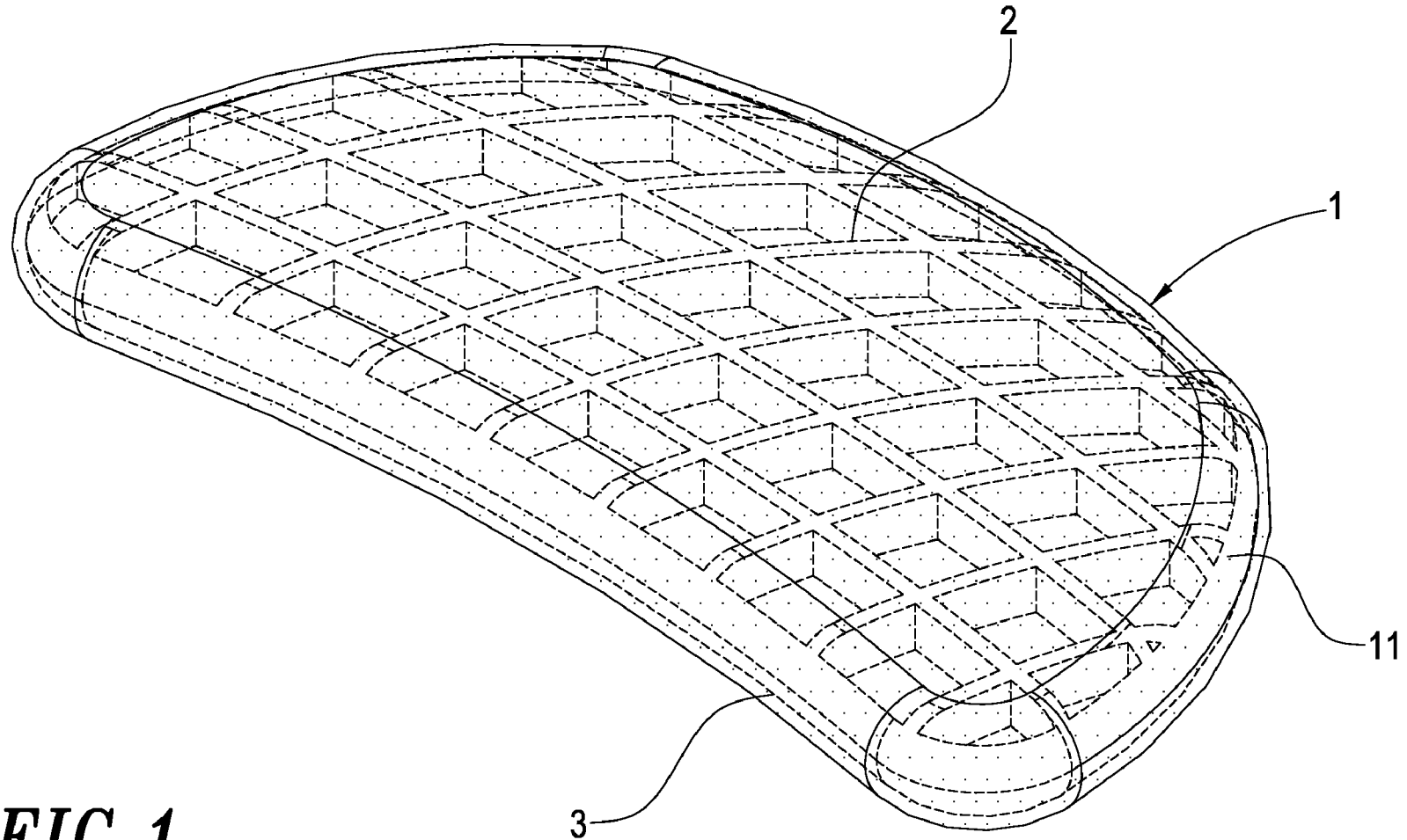
FIG. 1 is a perspective view illustrating the back cushion of the present invention.
Figure 2:
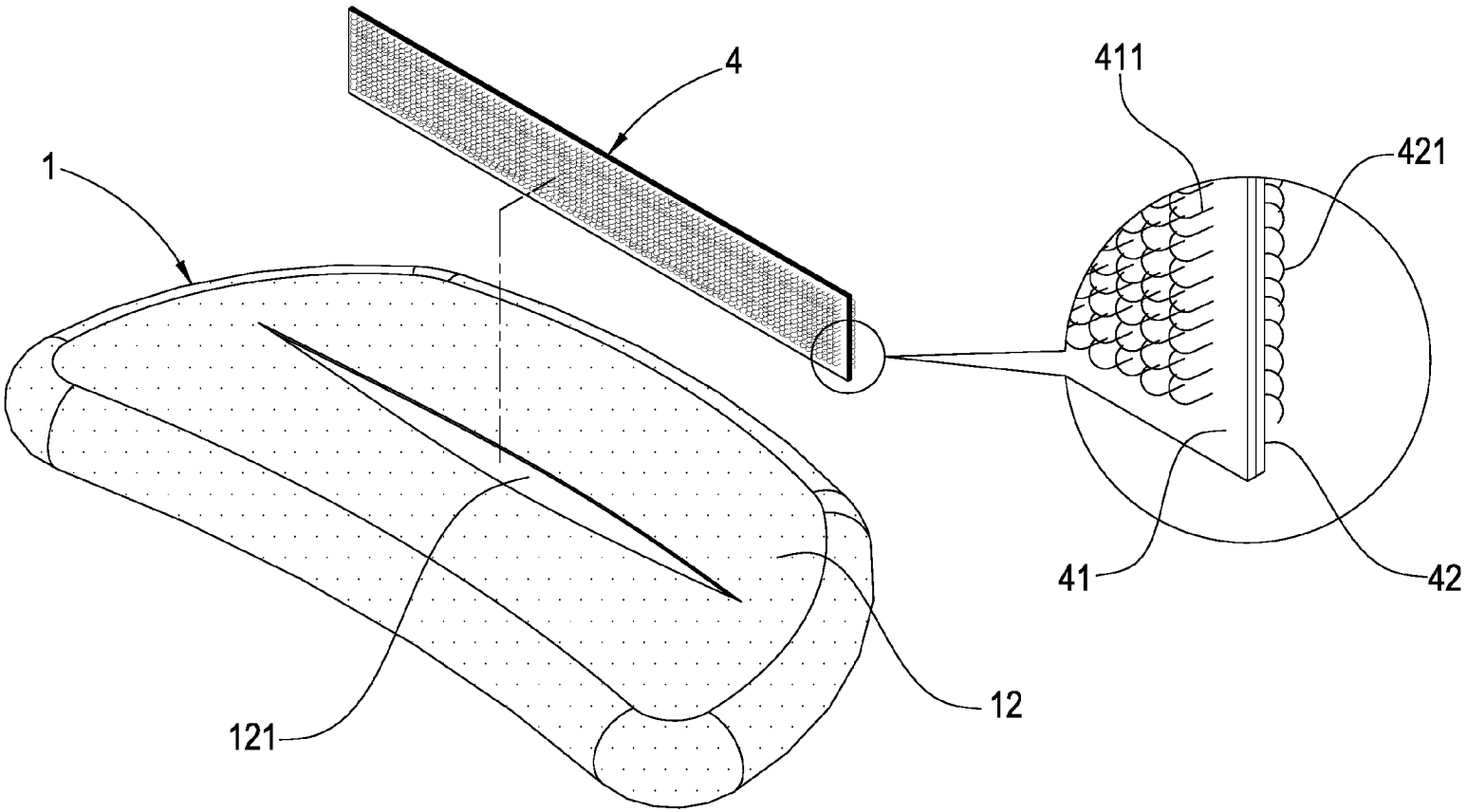
FIG. 2 is a partially exploded view illustrating the back cushion of the present invention.
Figure 3:
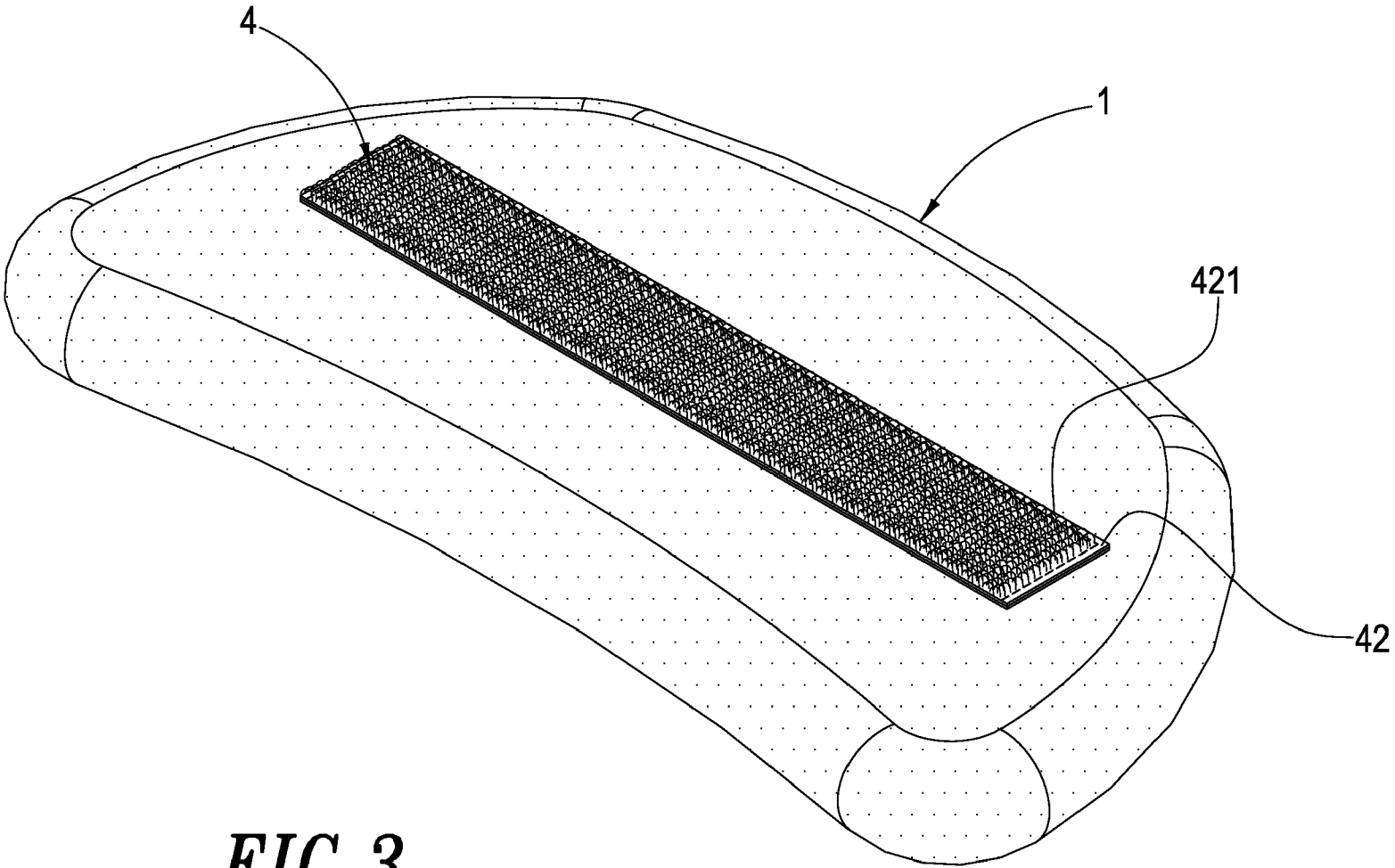
FIG. 3 is a perspective view illustrating the rear side of the back cushion of the present invention.
Figure 4:
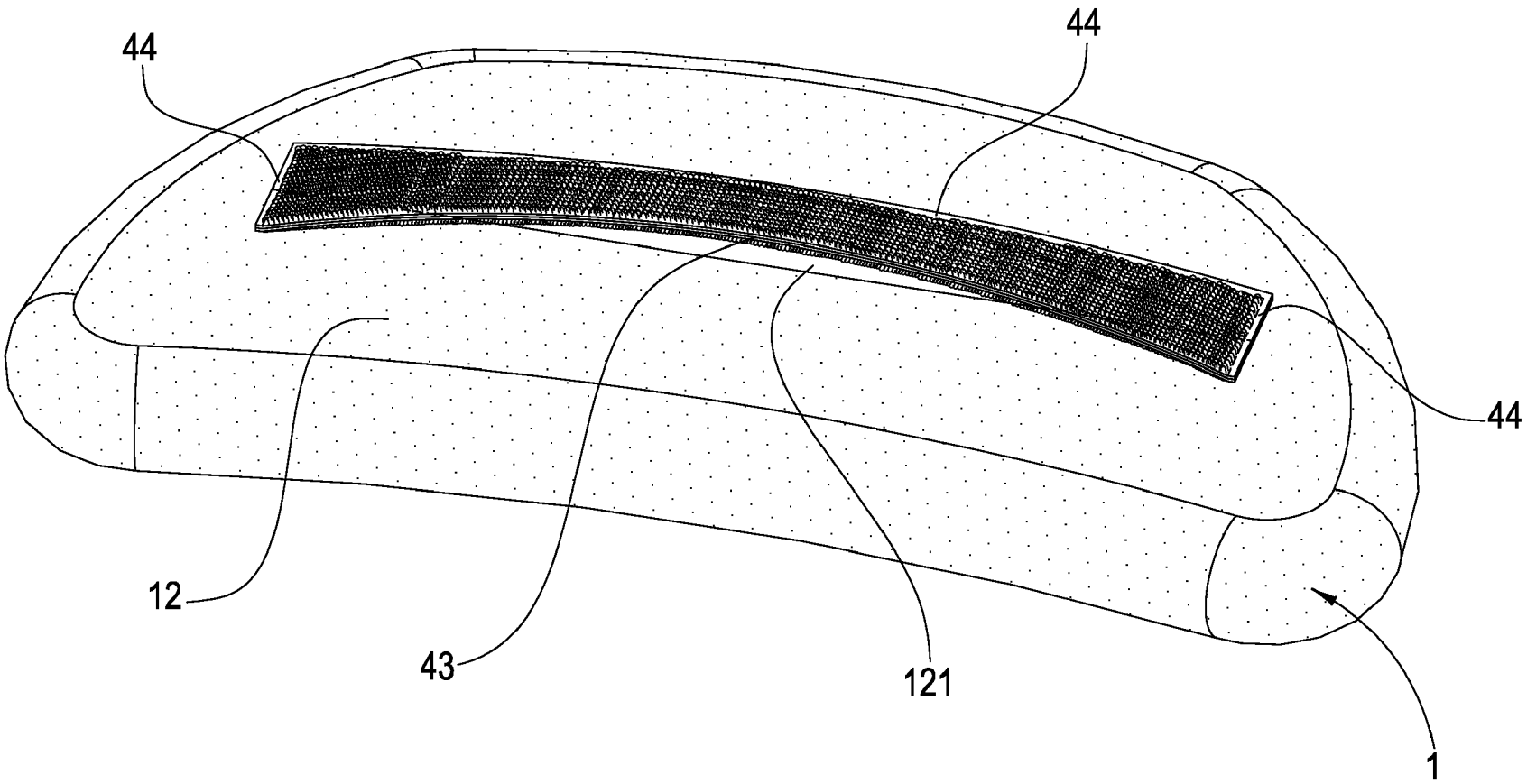
FIG. 4 is another perspective view illustrating the rear side of the back cushion of the present invention.

Please refer to FIGS. 1 to 5, which illustrate the back cushion of the present invention. The back cushion of the present invention comprises an enclosure portion 1, a buffer portion 2, a filler portion 3 and a fixing portion 4. The enclosure portion 1 has an internal space and has a first surface/layer 11 and a second surface/layer 12. An elongated opening 121 is provided in the second surface 12. The second surface 12 may be a hairier surface. In addition, the enclosure portion 1 may be made of woven fabric or elastic knitted fabric. The buffer portion 2 can lessen the effect of impacts. The buffer portion 2 may have a net-like design or a crisscross pattern or a solid design. The buffer portion 2 is fitted inside the internal space of the enclosure portion 1 so that the buffer portion 2 may be in contact with the first layer 11. In addition, the buffer portion 2 may be made of silicon gel, synthetic rubber gel, latex, soft PU or other elastor material. The filler portion 3 may be made of PU foam, synthetic foam or natural rubber foam. The filler portion 3 is fitted inside the internal space of the enclosure portion 1 so that the front surface of the filler portion 3 may be in contact with the buffer portion 2 and the rear surface of the filler portion 3 may be in contact with the second layer 12. The buffer portion 2 and the filler portion 3 fill up the internal space of the enclosure portion 1. The fixing portion 4 has a first fixing surface 41 and a second fixing surface 42. The first fixing surface 41 is connected with the second surface 12 of the enclosure portion 1 to close the elongated opening 121. After the fixing portion 4 is connected with the second surface 12 of the enclosure portion 1, there is at least an open end 43 and other sides 44 are closed. In addition, either the first fixing surface 41 or the second fixing surface 42 may be a hook surface 411 and 421 of the fabric Velcro fastener. Therefore, the first fixing surface 41 may be connected with the second surface 12, which has a loop surface. To take out the buffer portion 2 and filler portion 3 from the enclosure portion 1, disconnect the first fixing surface 41 from the second layer 12 and then take out the buffer portion 2 and a filler portion 3 from the enclosure portion 1, and disconnect the first fixing surface 41 from the enclosure portion 1 through the open end 43 and elongated opening 121. Now, we can wash or clean up the enclosure portion 1, buffer portion 2 and filler portion 3.

Figure 6:
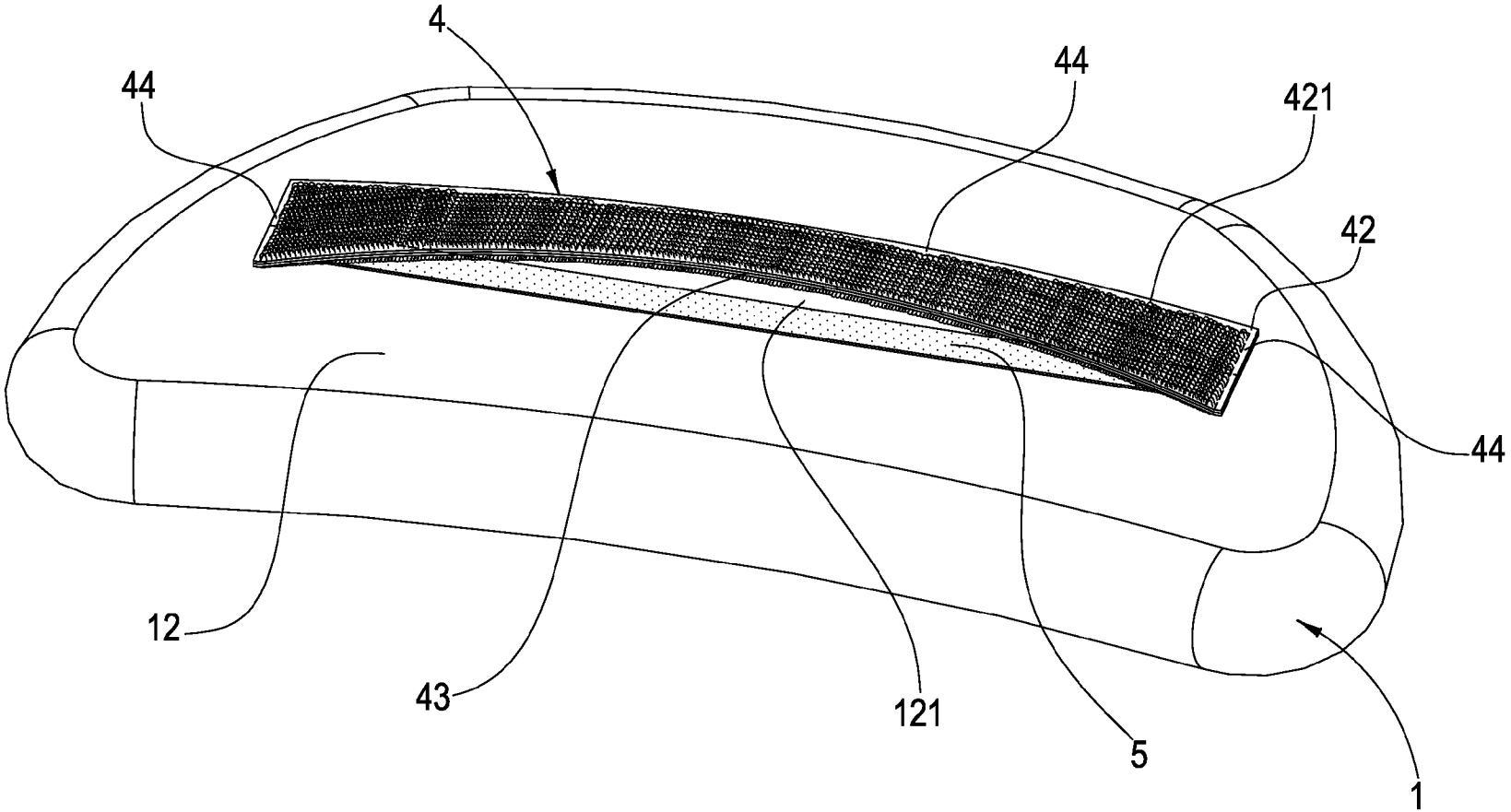
FIG. 6 is a perspective view illustrating another embodiment of the present invention.

Please see FIG. 6, which is a perspective view illustrating another embodiment of the present invention. If the enclosure portion 1 is made of leather, a loop-surfaced piece 5 is fitted by the elongated opening 121 and is roughly aligned with the open end 43. Therefore, the open end 43 may be connected with the piece 5 to close the elongated opening 121.

Figure 7A:
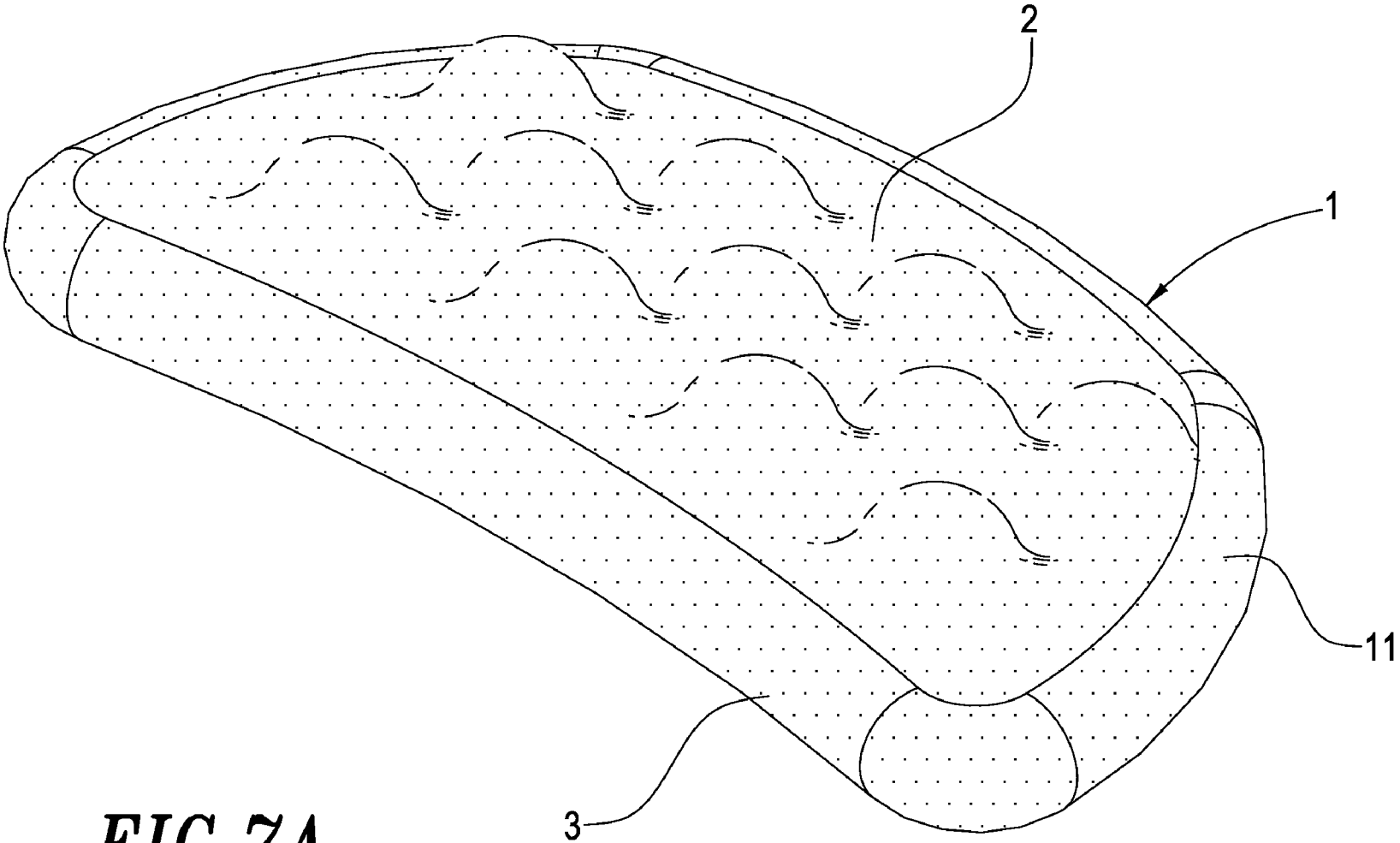
FIGS. 7A and 7B are two views illustrating a third embodiment of the present invention.
Figure 7B:
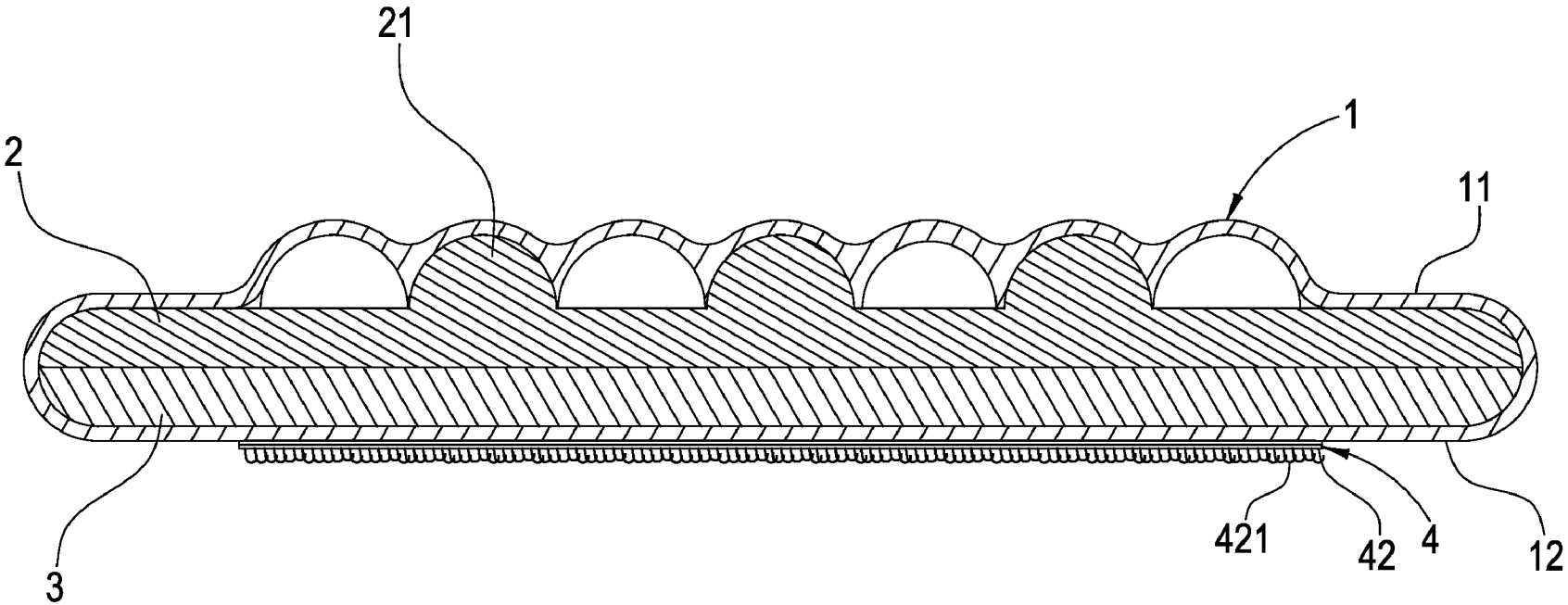

Please see FIGS. 7A and 7B, which are two views illustrating a third embodiment of the present invention. The buffer portion 2 may have several protrusions 21, which can massage the back of a user when he rest against the back cushion of the present invention.

Figure 8:
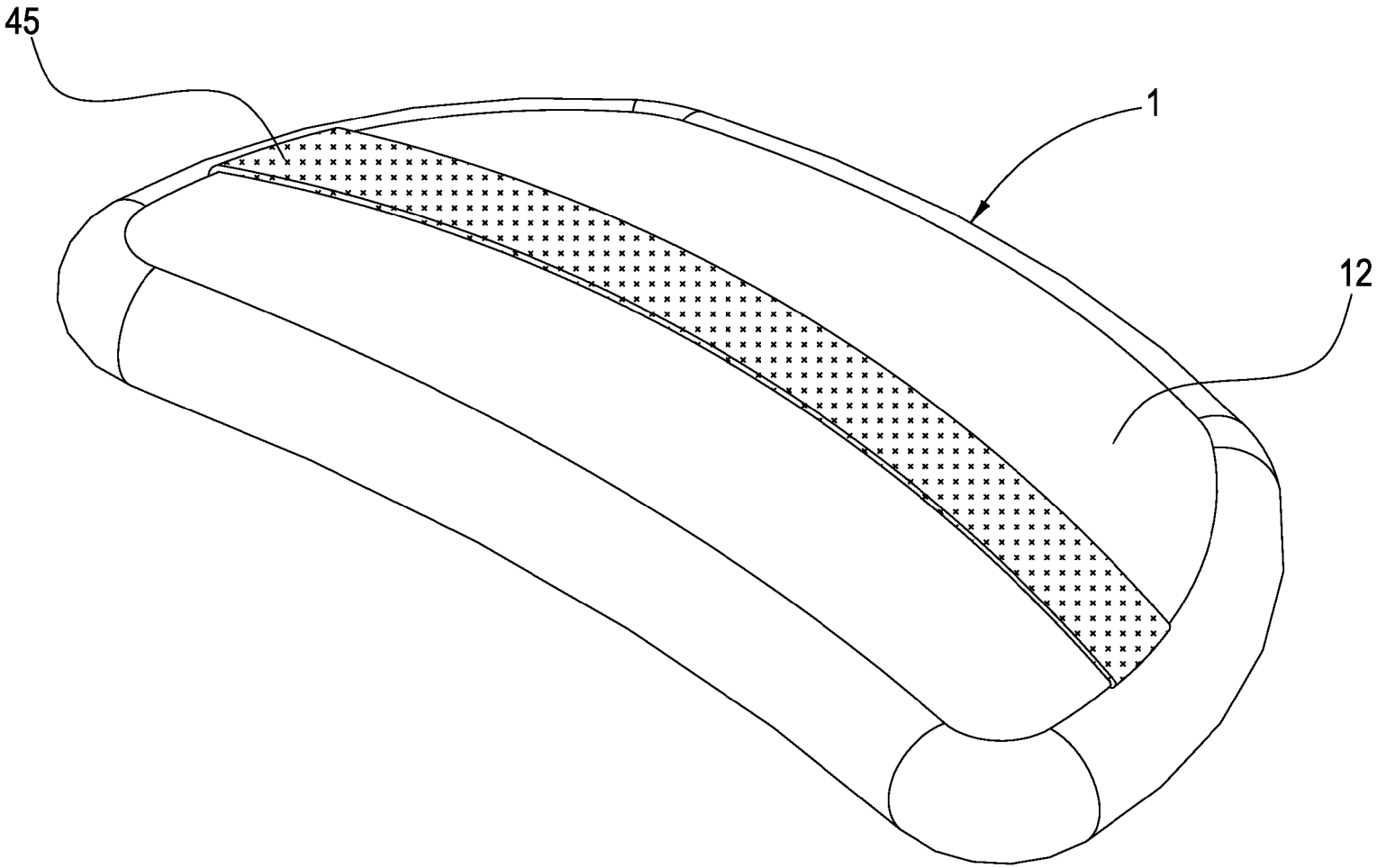
FIG. 8 is a perspective view illustrating a fourth embodiment of the present invention.

Please see FIG. 8, which is a perspective view illustrating a fourth embodiment of the present invention. The fixing portion 4 may be an elastic band 45, which is connected to the second layer 12 of the enclosure portion 1. Therefore, the enclosure portion 1, which holds the buffer portion 2 and the filler portion 3, may be attached to a chair through the elastic band 45.

Figure 5:
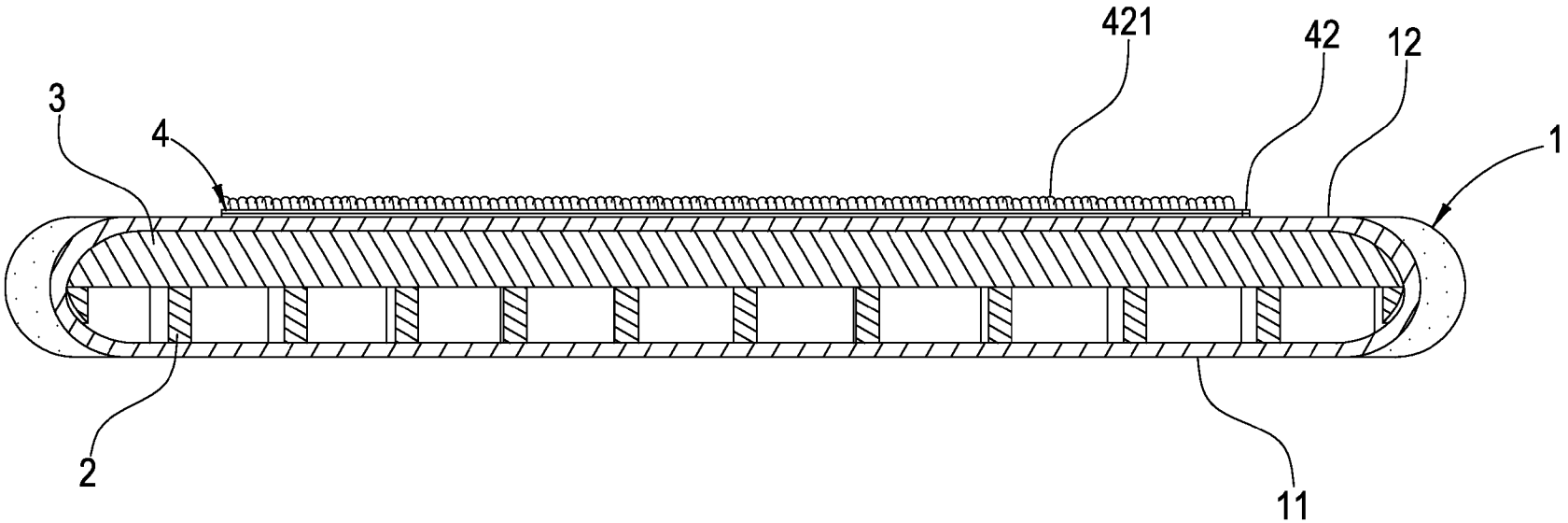
FIG. 5 is a sectional view illustrating the back cushion of the present invention.
Figure 9A:
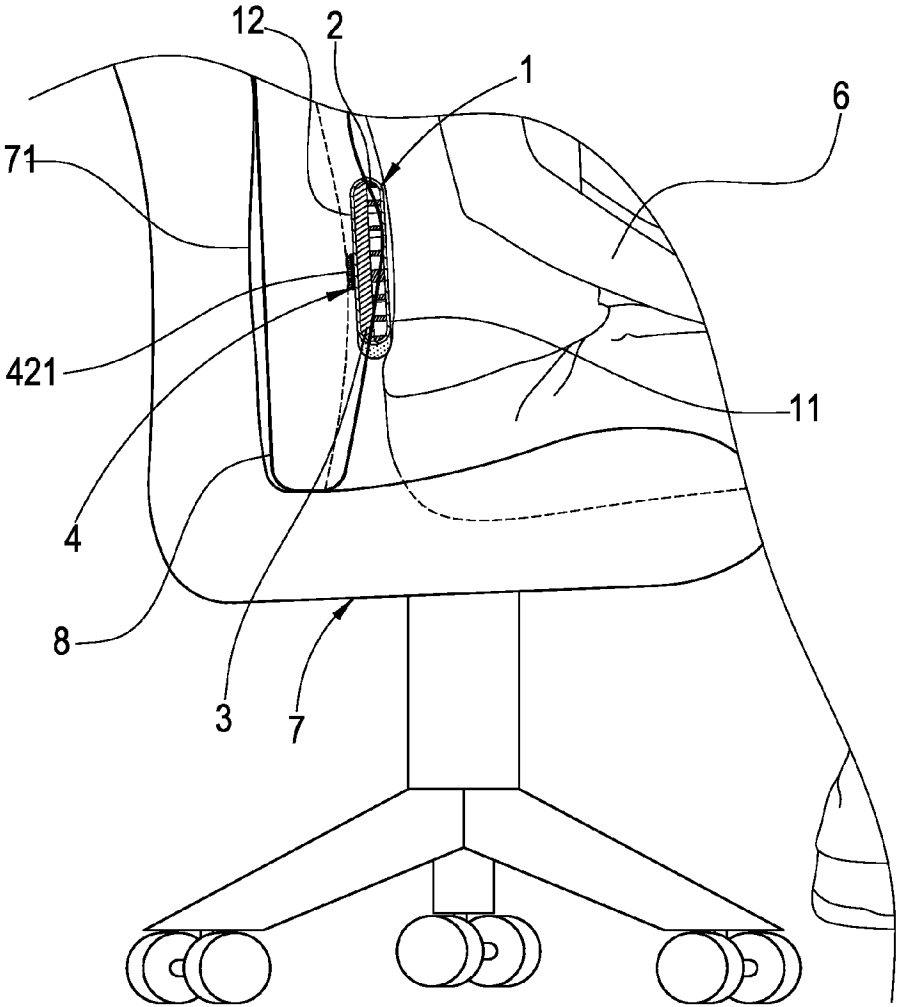
FIGS. 9A and 9B are two views illustrating how the back cushion of the present invention is used.
Figure 9B:
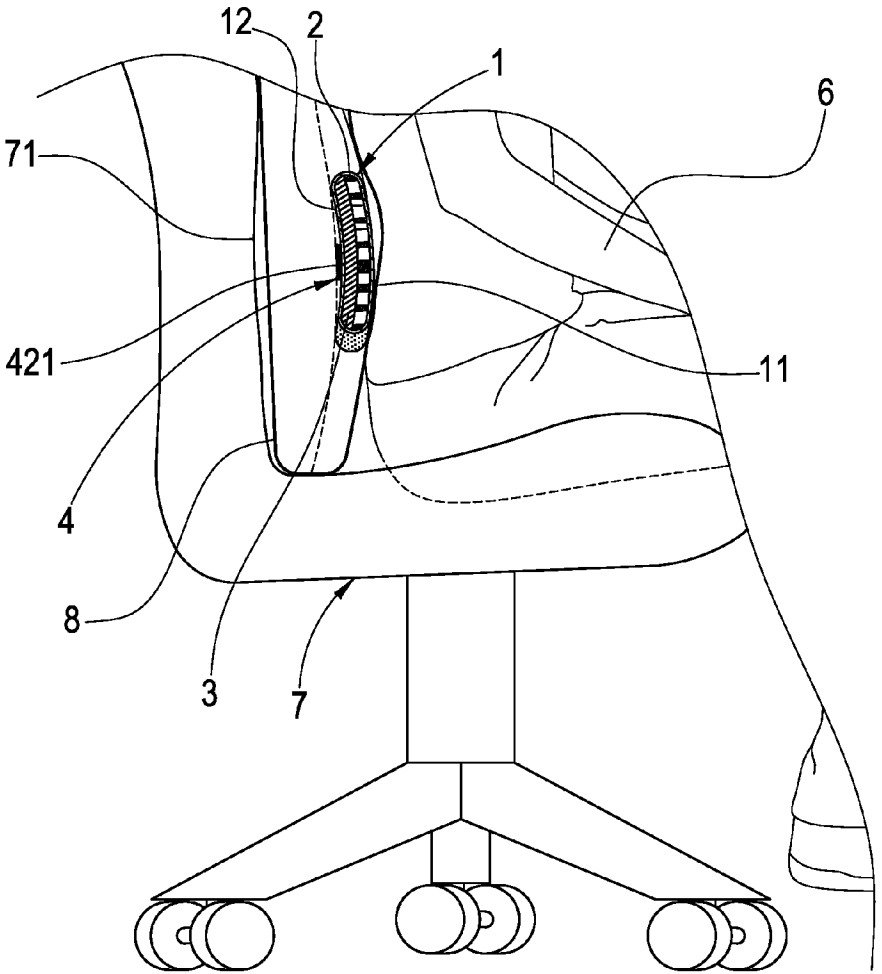

Please see FIGS. 5, and 9A and 9B. FIGS. 9A and 9B are two views illustrating how the back cushion of the present invention is used. A user 6 may place the back cushion of the present invention at a proper place on the backrest 71 of a chair 7 or a supporting member 8 through the second fixing surface 42. When the user 6 sits on the chair 7, the buffer portion 2 can lessen the effect of impacts and provide cushioning; therefore, the back of the user 6 may be comfortably cushioned and supported.

In comparison to the prior art, the back cushion of the present invention has the following advantages:

1. In the back cushion of the present invention, a buffer portion is used. Hence, the back of a user may be comfortably cushioned and supported and injuries to his back may be avoided.

2. In the back cushion of the present invention, a fixing portion, which is connected with the second layer of the enclosure portion, is used. Hence, a user may place the back cushion at a proper place of his choice.

Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A back cushion, comprising:

an enclosure portion, having an internal space, a first layer and a second layer, wherein an elongated opening is provided in the second layer of the enclosure portion, the elongated opening is closed by using a hook and loop structure, both sides of the hook and loop structure have hook surfaces, and one side of the hook and loop structure is connected with the second layer having a loop surface for closing the elongated opening;

a buffer portion made of silicone gel, synthetic rubber, latex or soft PU, which is fitted inside the internal space of the enclosure portion and is in contact with the first layer;

a filler portion, which is fitted inside the internal space of the enclosure portion so that the front surface of the filler portion may be in contact with the buffer portion and the rear surface of the filler portion may be in contact with the second layer of the enclosure portion; and a fixing portion, which is connected with the second layer of the enclosure portion.

2. The back cushion as in claim 1, wherein the enclosure portion is made of woven fabric or elastic knitted fabric.

3. The back cushion as in claim 1, wherein the filler portion is made of foam, synthetic foam or natural rubber foam.

4. The back cushion as in claim 1, wherein the fixing portion may be a hook and loop fastener or an elastic band.

5. A back cushion, comprising:

an enclosure portion, having an internal space, a first layer and a second layer, wherein an elongated opening is provided in the second layer, and the second layer has a loop surface;

a buffer portion made of silicone gel, synthetic rubber, latex or soft PU, which is fitted inside the internal space of the enclosure portion and may be in contact with the first layer;

a filler portion, which is fitted inside the internal space of the enclosure portion so that the front surface of the filler portion may be in contact with the buffer portion and the rear surface of the filler portion may be in contact with the second layer of the enclosure portion; and a fixing portion, having a first fixing surface and a second fixing surface, wherein the first fixing surface is a hook surface and is connected with the second layer of the enclosure portion to close the elongated opening, characterized in that, after the fixing portion is connected with the second layer of the enclosure portion, there is at least an open end and other sides are closed.

6. The back cushion as in claim 5, wherein the enclosure portion is made of woven fabric or elastic knitted fabric.

7. The back cushion as in claim 5, wherein a loop-surfaced piece is fitted by the elongated opening and is roughly aligned with the open end, characterized in that the first fixing surface may be connected with the second layer of the enclosure portion.

8. The back cushion as in claim 5, wherein the buffer portion may have several protrusions.

9. The back cushion as in claim 5, wherein the fixing portion may be a hook and loop fastener.

10. The back cushion as in claim 5, wherein the filler portion may be made of foam, synthetic foam or natural rubber foam.

* * * * *